United States Patent [19]

Steeghs

[11] 4,128,790

[45] Dec. 5, 1978

[54] CATHODE RAY TUBE FOR DISPLAYING COLORED PICTURES

[75] Inventor: Martin H. G. Steeghs, Eindhoven, Netherlands

[73] Assignee: U.S. Philips Corporation, New York, N.Y.

[21] Appl. No.: 746,878

[22] Filed: Dec. 2, 1976

[30] Foreign Application Priority Data

Dec. 23, 1975 [NL] Netherlands ..... 7514975

[51] Int. Cl.[2] ..... H01J 29/58

[52] U.S. Cl. ..... 315/382; 315/31 TV

[58] Field of Search ..... 315/31 R, 31 TV, 382, 315/17, 376; 313/408

[56] References Cited

U.S. PATENT DOCUMENTS

| | | | |
|---|---|---|---|
| 2,728,024 | 12/1955 | Ramberg | 315/31 TV |
| 3,421,048 | 1/1969 | Christensen | 315/31 TV |
| 3,502,942 | 3/1970 | Khan et al. | 315/31 TV |

OTHER PUBLICATIONS

*Silicon Zener Diode and Rectifier Handbook,* Motorola, Inc., 2nd Edition, 1961, p. 110.

*Primary Examiner*—Maynard R. Wilbur
*Assistant Examiner*—Lawrence Goodwin
*Attorney, Agent, or Firm*—Algy Tamoshunas

[57] ABSTRACT

Disclosed is a cathode ray tube of the postfocusing type for displaying color pictures having an apertured color selection means with an electrostatic postfocusing lens formed in each of the apertures. The electrodes of the color selection means at the higher potential are connected to a high voltage connection of the tube and the electrodes at the lower potential are charged by the electron beams with their voltage being stabilized by a series arrangement of zener diodes connected to the high voltage connection of the tube.

1 Claim, 5 Drawing Figures

CATHODE RAY TUBE FOR DISPLAYING COLORED PICTURES

Figure 1:
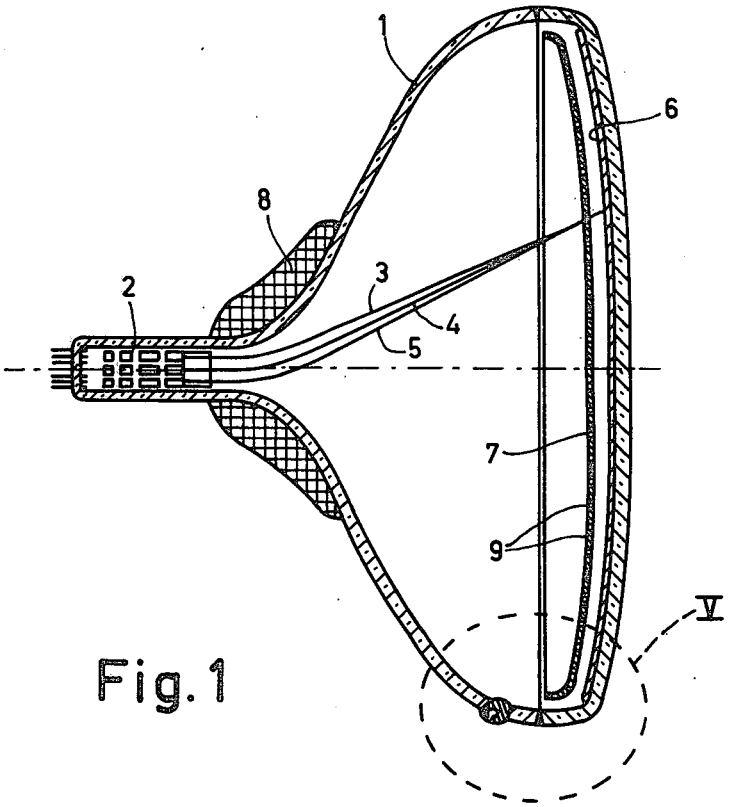

The invention relates to a cathode ray tube for displaying colour pictures comprising, in an evacuated envelope, means to generate a number of electron beams, a display screen having a large number of regions luminescing in different colours, and colour selection means which assigns each electron beam to luminescent regions of one colour. The colour selection means includes electrodes at two different potentials for postfocusing the electron beams.

Such a postfocusing tube is described in the U.S. Pat. No. 2,728,024. In this tube the electron beams successively pass through two grids consisting of parallel conductors with the conductors belonging to different grids extending at right angles to each other. As a result, the electron beams are focused successively by two electron optical cylinder lenses which are rotated 90° relative to each other. By the action of both lenses, the electron beams are focused in one direction and are defocussed in a direction at right angles thereto.

Another type of postfocusing tube to which the invention relates is described in the Dutch patent application No. 74.09.642 in which a quadrupole lens is formed in each aperture of the colour selection means.

Postfocusing tubes of the type described above in which the colour selection means comprises electrodes at two different potentials are provided with two connections for supplying the required high voltages.

It is the object of the invention to provide such a postfocusing tube which need be connected only to one high voltage source.

According to the invention, in a cathode ray tube of the type mentioned in the preamble, the electrodes of the colour selection means which are at the higher potential are connected electrically to a high voltage connection of the tube and the electrodes which are at the lower potential are connected electrically to the anode of a voltage stabilization rectifier, the cathode of which is connected to the high voltage connection.

A voltage stabilization rectifier as the term is used herein is to be understood to mean a semiconductor diode which is connected in the reverse direction or a series arrangement of such diodes, which are generally referred to as Zener diodes. As is known, a Zener diode shows a sharp bend in the reverse characteristic at the so-called Zener voltage.

In a cathode ray tube according to the invention, the electrodes which are at the lower voltage are charged negatively by the electron beams, with the electron gun serving as a current source. As a result of this, the potential of the electrodes decreases at a rate proportional to the received quantity of electric charge and inversely proportional to the capacitance of the electrodes relative to their surroundings. When the voltage difference rises to a value which is larger than the overall Zener voltage of the Zener diodes, they become conductive and carry of the charge which would cause the voltage difference to increase further. In this manner the potential of the electrodes is stabilized at a value which is equal to the high voltage supplied to the tube reduced by the Zener voltage.

The voltage stabilization rectifier is preferably mounted within the envelope of the tube. The advantage of this is that the tube need be provided with only one high voltage connection.

Figure 2:
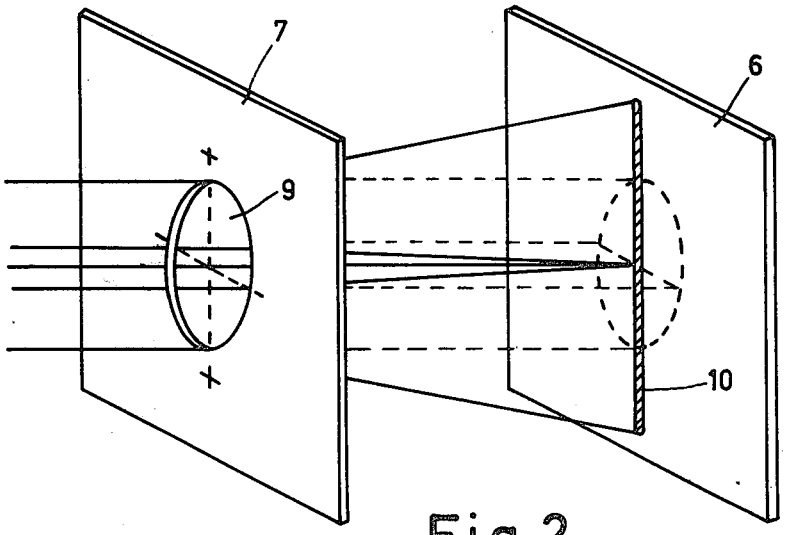
Figure 3:
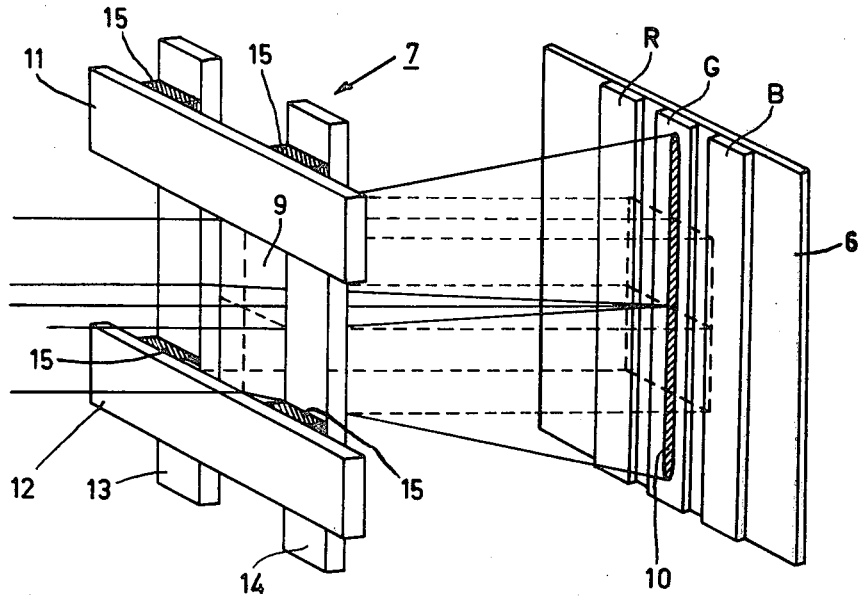
Figure 4:
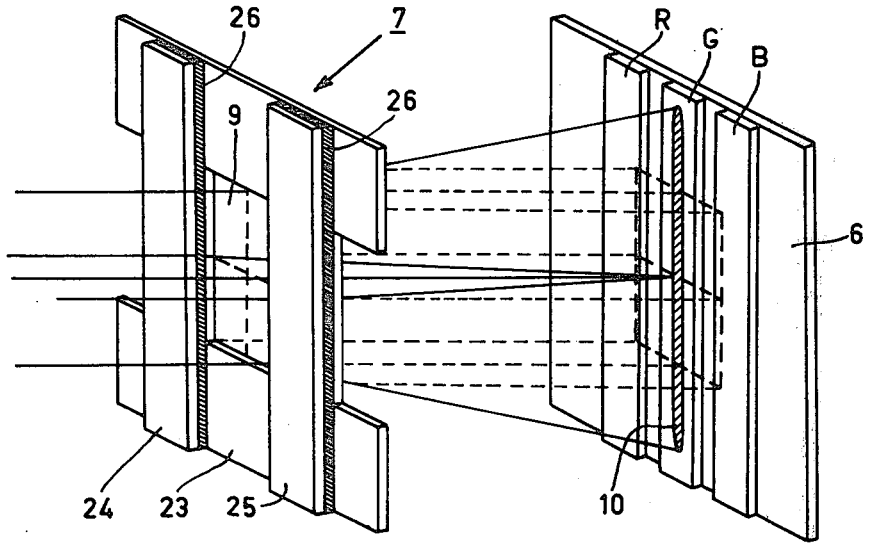
Figure 5:
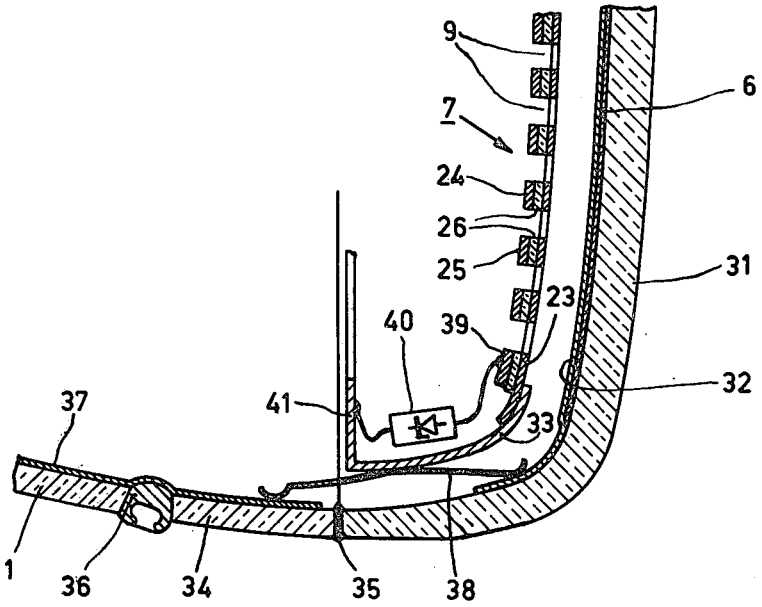

The invention will be described in greater detail with reference to the accompanying drawings, of which FIG. 1 shows a cathode ray tube for displaying colour pictures, FIG. 2 serves to explain a possible method of postfocusing, FIG. 3 shows a first embodiment of a tube according to the invention, FIG. 4 shows a second embodiment of a tube according to the invention, and FIG. 5 shows a portion of the tube shown in FIG. 1 at an enlarged scale and in greater detail.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue, the longitudinal direction of which is at right angles to the plane of the drawing of FIG. 1. During normal operation of the tube the phosphor strips are vertical and FIG. 1 thus represents a horizontal sectional view of the tube. The colour selection means 7, which will be described in greater detail with reference to FIGS. 3 and 4, comprise a large number of apertures 9 which are shown diagrammatically in FIG. 1. The three electron beams 3, 4 and 5 pass through the apertures 9 at a small angle with each other and consequently each impinges only upon phosphor strips of one colour. The apertures 9 in the colour selection means 7 are hence very accurately positioned relative to the phosphor strips of the display screen 6. In shadow mask tubes generally used at the present time, the electron beams 3, 4 and 5 are not focused upon passing through the apertures 9.

In a postfocusing tube, for example, a quadrupole lens can be formed in each aperture 9. FIG. 2 shows diagrammatically such a quadrupole lens. Shown in a part of the colour selection means 7 and one of the apertures 9. The potential variations along the edge of the aperture 9 is denoted by +, −, +, − in such manner that a quadrupole field is formed. An electron beam which passes through the aperture 9 is focused in the horizontal plane and is defocused in the vertical plane to form an electron spot 10, when the display screen is exactly at the horizontal focus. As will be described in detail, it is recommendable not to focus the beam exactly on the display screen 6 so that a slightly wider electron spot is obtained as a result of the slight defocusing. It is only of minor influence on the focusing when the electron beam passes through the aperture 9 at a small angle; as a result of this the colour selection of the three electron beams 3, 4 and 5 takes place in a manner quite analogous to that of known shadow mask tubes. However, as a result of the strong focusing, the aperture 9 can be made much larger than in known shadow mask tubes so that a far greater amount of electrons impinge upon the display screen 6 and a brighter picture is obtained. The defocusing in the vertical direction is not objectionable when phosphor strips are used which are parallel to the longitudinal direction of the spot 10. Such colour selection means having a large number of quadrupole lenses can be realized in a number of ways.

In FIG. 3 the colour selection means 7 is formed by two sets of parallel conductors crossing each other. In the arrangement shown in the figure, the conductors 11 and 12 of the first set are horizontal and the conductors 13 and 14 of the second set are vertically. The conductors 11, 12, 13 and 14 define one of the apertures 9 and are insulated from each other by means of insulation material 15. On the display screen 6, the three phosphor strips associated with the aperture 9 are denoted by R (red), G (green), and B (blue). The figure shows only a few rays of the central electron beam 4 which forms an electron spot 10 on the phosphor strip G. The horizontal conductors, of the colour selection means are mutually interconnected and are at a higher potential than the mutually interconnected vertical conductors, so that they form a quadrupole lens in each aperture 9, as shown diagrammatically in FIG. 2.

The following results are achieved with the colour selection means shown in FIG. 3 mounted in the display tube. The transmission of such a colour selection means with conductors having a width of 0.24 mm and a mutual pitch or spacing of 0.80 mm is approximately 50%. With the display screen 6 and the horizontal conductors at a potential of 25 kV and the vertical conductors at a potential of 24 kV, the focal distance of the quadrupole lenses is approximately 18.0 mm in the center of the display screen with perpendicular incidence and 12.7 mm with an incidence of 37° at the corners of the display screen. The distance from the colour selection means 7 to the display screen 6 is 15 mm in the center and 10 mm at the edge, so that the focus of the quadrupole lenses is everywhere just slightly beyond the display screen. As a result, this arrangement prevents the so-called focus ring from being visible on the display screen. The electron spots in the center of the display screen are then 0.10 mm wide and in the corners 0.09 mm wide. A suitable width for the phosphor strips R, G and B is then 0.13 mm. The remainder of the surface of the display screen may or may not be covered with a light-absorbing material.

FIG. 4 shows another embodiment of the colour selection means 7. In this case it is formed by an iron plate 23 provided with apertures 9 and a large number of vertical conductive strips between the apertures 9, two of which are denoted by 24 and 25 in the figure. The conductive strips are insulated from the iron plate by means of insulating material 26. The plate 23 is 0.15 mm thick. The insulation material 26, a glass layer, is 0.06 mm thick. The conductive strips consist of vapour-deposited aluminium and are 0.0005 mm thick. The holes 9 are 0.56 × 0.56 mm and their pitch or spacing is 0.8 mm so that the transmission of the colour selection means is approximately 50%. With the display screen 6 and plate 23 at a potential of 25kV, and the conductive strips 24 and 25 at a potential of 23.5 kV, the focal distance of the quadrupole lenses is 18 mm with perpendicular incidence in the center of the display screen and 12.7 mm with an incidence of 37° at the edge of the display screen. The distance between the display screen 6 and the colour selection means 7 is 15 mm in the center of the display screen and 10 mm at the edge. The width of the electron spots in the center of the display screen and in the corners is then 10mm and 0.09 mm, respectively, and there is no focus ring visible on the display screen. The width of the phosphor strips R, G and B is 0.13 mm. The remainder of the display screen may or may not be provided with a light-absorbing material.

A display screen for a tube according to the invention can be manufactured by known methods, such as by an exposure method in which the colour selection means is reproduced on a photosensitive layer on the window portion of the tube. In connection with the larger transmission of the colour selection means according to the invention, the exposure method used should be suitable to reproduce the apertures in a considerably narrowed manner. An exposure method suitable for this purpose used two or more light sources at some distance from each other, as described, for example, in German patent application No. 2,248,878. Of course a tube according to the invention is also excellently suitable for the so-called electronic exposure in which the sensitive layer on the window portion is "exposed" by means of an electron beam. FIG. 5 shows the portion of the tube denoted by V in FIG. 1 at an enlarged scale and in greater detail. The colour selection means 7 is constructed in the manner described with reference to FIG. 4.

The display screen 6 on a window portion 31 of the tube has a thin conductive layer 32 of vapour-deposited aluminium. The colour selection means 7 is mounted in the window portion 31 by means of a metal ring 33, in known manner which is not further described. The window portion 31 is secured to a conical portion 34 of the tube by means of a sealing glass (seam 35). The conical portion 34 is provided with a high voltage connection 36 which is connected electrically to an internal conductive layer 37. Contact springs 38 connect the conductive layer 32 of the display screen 6 and the ring 33 to the conductive layer 37 and hence to the high voltage connection 36. The plate 23 (see also FIG. 4) is connected electrically to the ring 33. The electrodes 24, 25 etc. (see also FIG. 4) are mutually interconnected but are otherwise insulated from the plate 23 and from the ring 33 by the insulating material 26. The lowermost electrode 39, which is connected to the electrodes 24, 25 etc., is also connected to the anode of a voltage stabilization rectifier 40. The cathode of the rectifier 40 is connected to the high voltage via ring 33. The rectifier 40 consists of a series arrangement of twenty Zener diodes each having a Zener voltage of 75 volts, for example type BZX 79 of Philips, so that the overall Zener voltage is substantially 1.5 kV.

During operation of the tube, a voltage of 25 kV is applied to the high voltage connection 36 so that the voltage of the plate 23 and of the conductive layer 32 of the display screen 6 is also 25 kV. The electron beams generated in the tube are partly intercepted by the electrodes 24, 25 etc., as a result of which these electrodes are charged negatively. When the voltage of the electrodes 24, 25 etc. reaches the value of 23.5 kV, the voltage difference between the electrodes 24, 25, on the one hand, and the plate 23, on the other hand, is 1.5 kV and is equal to the overall Zener voltage of the Zener diodes. The voltage difference cannot increase further because of the conduction of the diodes which then occurs and cannot decrease because of the negative charge imparted thereto by the electron beams. As described earlier with reference to FIG. 4, the desired postfocusing is obtained with this voltage difference.

A tube having a built-in voltage stabilization rectifier according to the invention is interchangeable with a conventional shadow mask tube having the same electric specifications. The tube of the invention, however has a picture of a much higher light intensity.

Since the ring 33 entirely surrounds the colour selection means 7, there is sufficient space for a large number of series-arranged Zener diodes which are protected from the electron beams by the upright edge 41 of the ring 33.

The electrodes of the colour selection means 7 in general have sufficient capacitance relative to each other to maintain the required potential difference even if the beam current should temporarily become very small. If desired the capacitance of the colour selection means can be increased by means of a parallel-connected capacitor.

What is claimed is:

1. A cathode ray tube for displaying colour pictures comprising in an evacuated envelope, means to generate a plurality of electron beams, a display screen having a large number of regions luminescing in different colours, colour selection means for assigning each electron beam to luminescent regions of one colour, said colour selection means including at least two electrodes at two different potentials for postfocusing the electron beams, and a voltage stabilizing rectifier having a cathode and an anode, the electrode of said colour selection means at the lower of said two different potentials being electrically connected to said anode of said rectifier and the electrode of said colour selection means at the higher potential and said cathode of said rectifier being electrically connected to a high voltage connection of the tube, said voltage stabilizing rectifier being mounted within said envelope in order to reduce the total number of external connections for said electrodes to a single external connection.

* * * * *